US007900415B2

(12) United States Patent
García Azcué

(10) Patent No.: US 7,900,415 B2
(45) Date of Patent: Mar. 8, 2011

(54) PROCEDURE TO MANUFACTURE PALM ROOF TILES FOR RUSTIC ROOFS AND THE OBTAINED PRODUCT

(76) Inventor: Armando Carlos García Azcué, Puebla (MX)

( * ) Notice: Subject to any disclaimer, the term of this patent is extended or adjusted under 35 U.S.C. 154(b) by 299 days.

(21) Appl. No.: 11/800,104

(22) Filed: May 4, 2007

(65) Prior Publication Data

US 2008/0047216 A1 Feb. 28, 2008

(30) Foreign Application Priority Data

Aug. 23, 2006 (MX) ..... PA/A/2006/009635

(51) Int. Cl.
*E04D 1/34* (2006.01)

(52) U.S. Cl. ..... 52/543; 52/745.19

(58) Field of Classification Search ..... 52/543, 52/745.19

See application file for complete search history.

(56) References Cited

U.S. PATENT DOCUMENTS

| | | | | |
|---|---|---|---|---|
| 233,269 | A * | 10/1880 | McClelland | 52/750 |
| 614,478 | A * | 11/1898 | Johnston | 52/750 |
| 2,700,404 | A * | 1/1955 | Birnie | 144/360 |
| 4,828,890 | A * | 5/1989 | Tiedeman et al. | 428/22 |
| 4,947,611 | A | 8/1990 | Otsuka | |
| 6,226,949 | B1 * | 5/2001 | Huber | 52/555 |
| 6,319,431 | B1 * | 11/2001 | Basson et al. | 252/607 |
| 6,324,791 | B1 | 12/2001 | Villar | |
| 6,601,723 | B1 * | 8/2003 | Ziglar | 220/4.34 |
| 6,715,251 | B2 * | 4/2004 | Yang | 52/555 |
| 6,802,325 | B1 * | 10/2004 | Apple | 135/33.2 |
| 2004/0031213 | A1 * | 2/2004 | Huber et al. | 52/96 |
| 2005/0235580 | A1 * | 10/2005 | Golden | 52/79.1 |
| 2005/0285293 | A1 * | 12/2005 | Brown et al. | 264/51 |

FOREIGN PATENT DOCUMENTS

| | | | |
|---|---|---|---|
| DE | 120033 | | 3/1900 |
| DE | 10300651 | * | 9/2004 |
| FR | 2612445 | | 9/1988 |
| GB | 335189 | | 9/1930 |
| JP | 6285819 | | 10/1994 |

* cited by examiner

*Primary Examiner* — Richard E Chilcot, Jr.
*Assistant Examiner* — Mark R Wendell
(74) *Attorney, Agent, or Firm* — Duane Morris LLP

(57) ABSTRACT

Provided herein are compositions for palm tile, which consists of an assembly of leaves of the palm tree *Brahea dulcis*, previously torn, placed in a uniformly and symmetrically way and lengthwise sown, stapled or held to the part where the petiole meets the lamina to form a tile, board, panel or Hawaiian skirt. Also provided herein are methods to manufacture the tiles and elements for its elaboration and placement on crosspieces of a structure.

18 Claims, 19 Drawing Sheets

PROCEDURE TO MANUFACTURE PALM ROOF TILES FOR RUSTIC ROOFS AND THE OBTAINED PRODUCT

CROSS-REFERENCES TO RELATED APPLICATIONS

This application is entitled to priority under the Paris Convention Treaty to Mexican patent application PA/a/2006/009635, which was filed on 23 Aug. 2006.

BACKGROUND OF THE INVENTION

The disclosure relates generally to the field of construction materials. It is a new product called palm tile that can be used to construct roofs or to cover huts or "palapas". This is a new procedure to manufacture palm tiles.

In several places and communities in the world, natural leaves, stems, branches, grass or hay are still being used for constructing traditional roofs of houses or shelters. In Mexico and other countries, stretched or pressed leaves from palm trees are tied up or fastened onto wooden or other material structures to construct roofs or covers for huts or "palapas".

In the traditional system to construct rustic roofs, the framework is assembled first; stretched or pressed palm leaves are then fastened or affixed thereto. However, fastening or fixing these leaves to the structure is a hardworking and slow job, which is both expensive and inconvenient because it takes a lot of time for workers to do it.

To construct roofs of huts and "palapas" using natural leaves and branches among other materials, various types of frameworks are used, whether conic or sloping (e.g., single pitch or double pitch roof) or eccentric. In all cases, material is laid and tied to use in overlaid portions, overlapping its position depending on the vegetal material used, with the previously mentioned inconveniences.

Patent literature disclosing frameworks and wall materials, such as U.S. Pat. No. 6,324,791, GB 335,189, DE 120,033, U.S. Pat. No. 4,947,611, JP 6,285,819, and FR 2,612,445, appear to have no close relation to the palm tiles as disclosed herein.

Provided herein is information for the construction of palm tiles or thatched roofs, rustic roofs for huts or "palapas", which surpasses the inconveniences of the traditional technique. Collocation time is also reduced with highly satisfactory results. Also disclosed are methods to manufacture palm tiles, some accessories to fix them, and the manner to fix it onto a framework.

BRIEF SUMMARY OF THE INVENTION

The palm tile disclosed herein is an ensemble from the *Brahea dulcis* (*B. dulcis*) palm leaves placed uniformly and symmetrically which previously were cut lengthwise or in narrow strips, sewed, stapled or fastened to the part where the petiole connects its lamina as a tile, panel, leaf or Hawaiian skirt and used to construct rustic roofing or to decorate.

The palm leaves of these tiles can be sewed or fastened with different materials. The tiles can have different sizes, lengthwise and widthwise according to the actual size of the leaves.

An object of the disclosure is to provide a new method or system to construct rustic roofs with a "finished" product called palm tile.

Another objective is to provide a system of fixing or fastening the tiles onto crosspieces or leashes using clips, hooks, screws, staples, and the like leading to a much faster and expeditious system.

Also, another objective is to provide the procedure for the manufacturing of palm tiles, especially from *Brahea dulcis* where the palm leaves are placed and fastened and can be used to construct rustic roofing or for decoration.

Using the methods and teachings disclosed herein, one of ordinary skill in the art will be able to make similar products using natural homologous or analogous materials, including designing different bases and fasteners depending upon need or desire. Other uses and objectives will be clearer based upon the detailed description that follows.

DETAILED DESCRIPTION OF THE INVENTION

Figure 1:
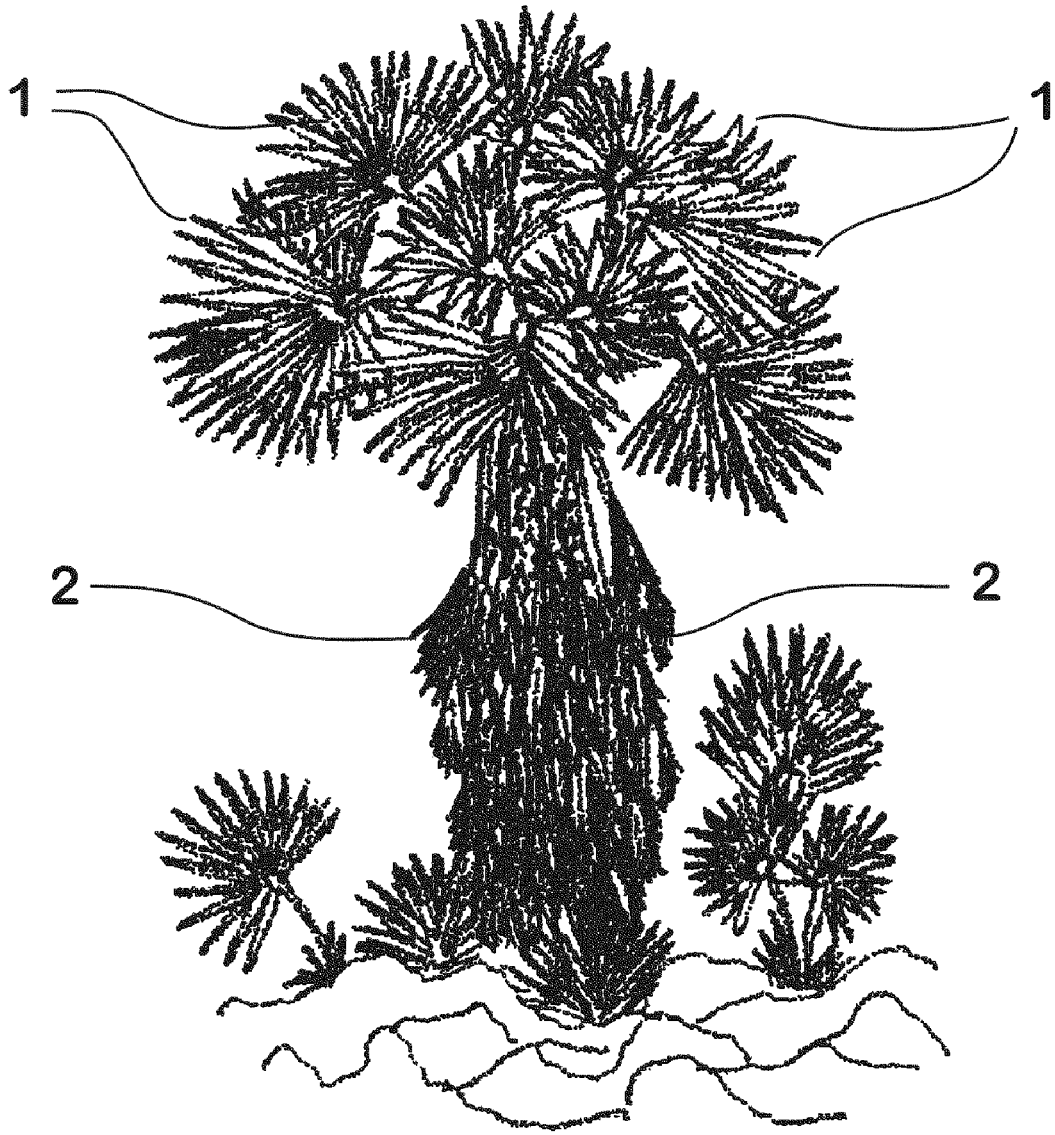
FIG. 1 is a conventional inferior view of a palm plant *B. dulcis* with some inferior leaves fallen.
Figure 2:
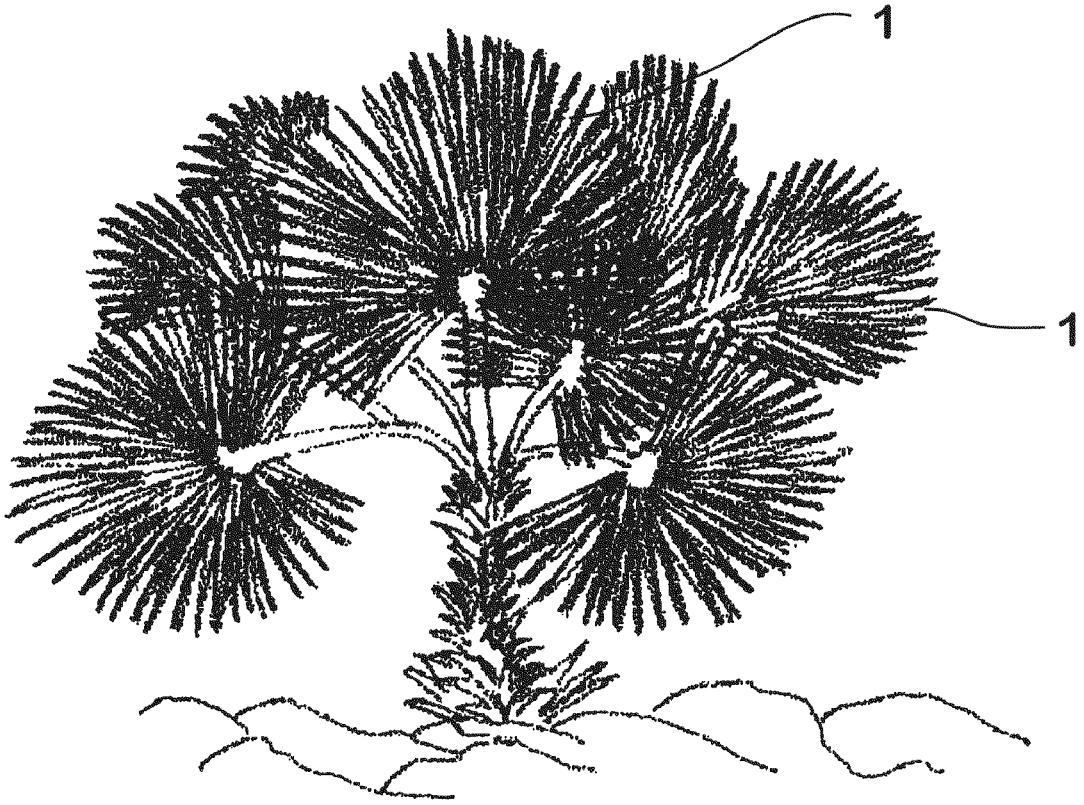
FIG. 2 is a conventional superior view of the plant shown in FIG. 1.
Figure 3:
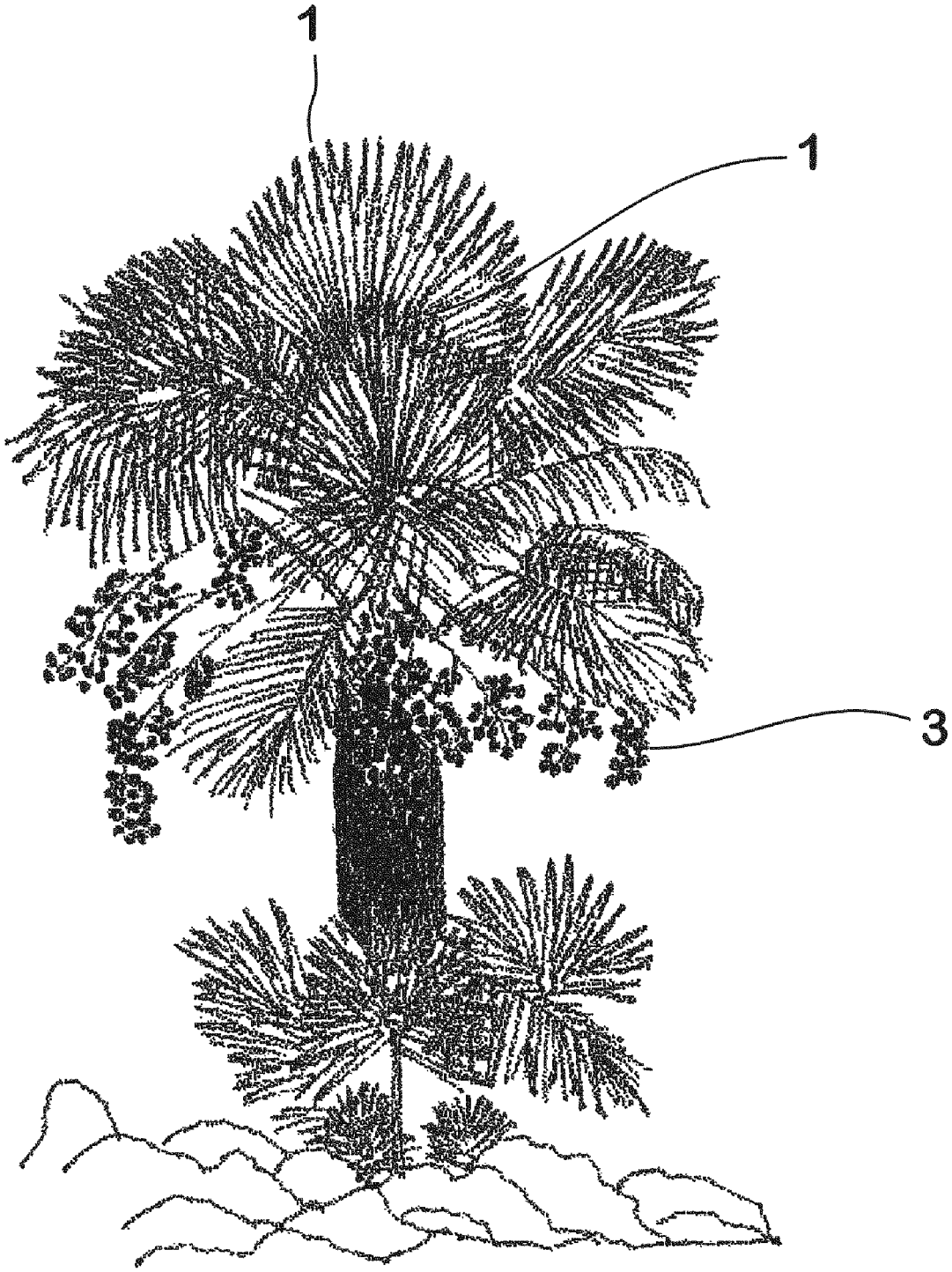
FIG. 3 is a view of plant *B. dulcis* showing hanging inflorescence in a raceme shape.
Figure 4:
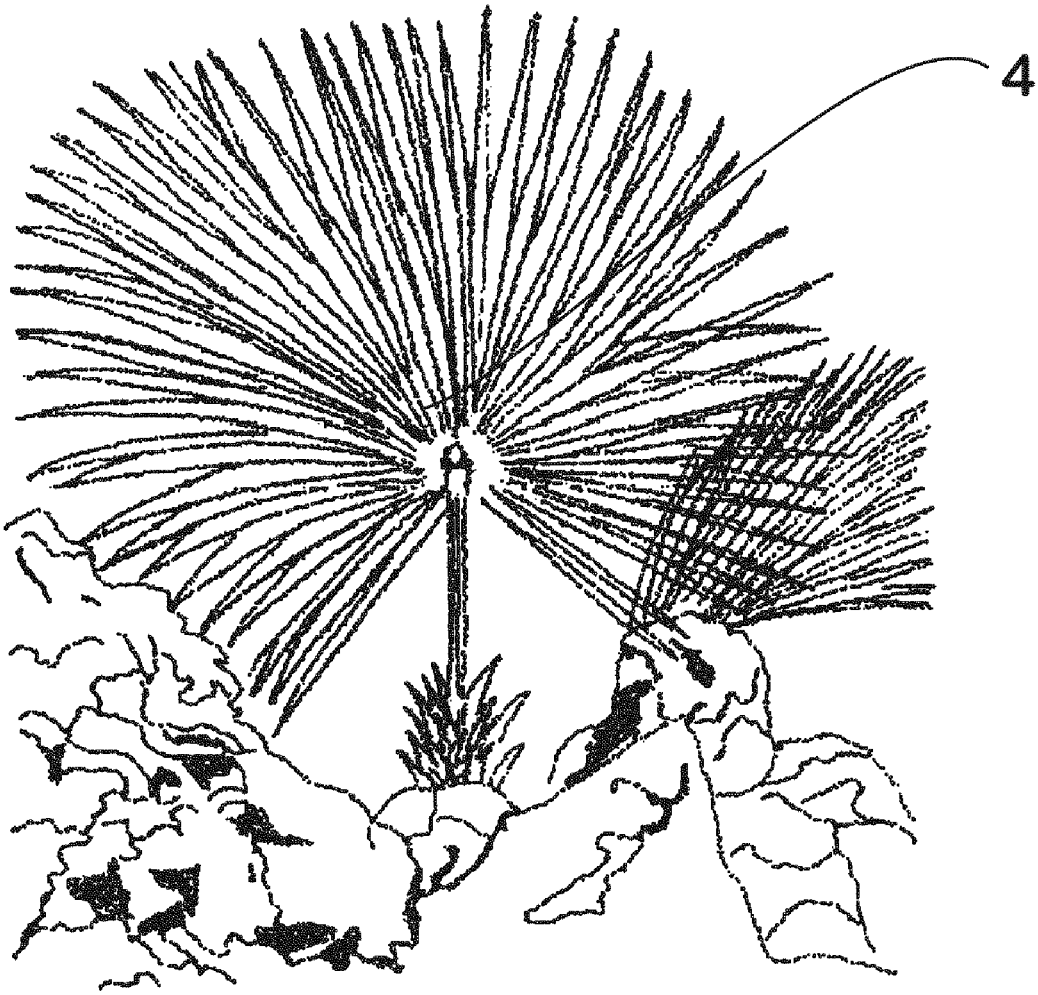
FIG. 4 shows a ripe palm leaf in a fan shape.
Figure 5:
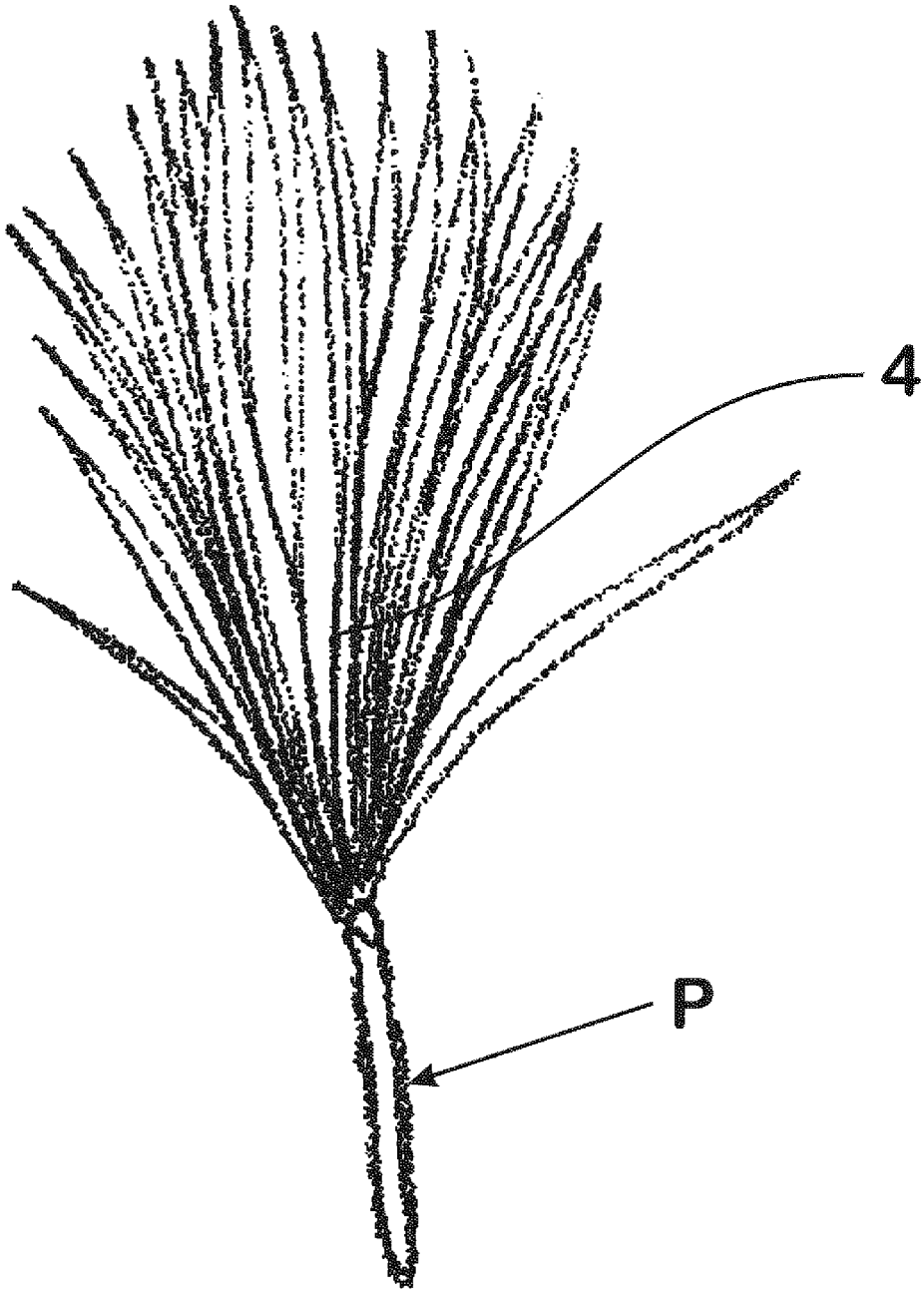
FIG. 5 shows a palm leaf that contracts after being cut.
Figure 6:
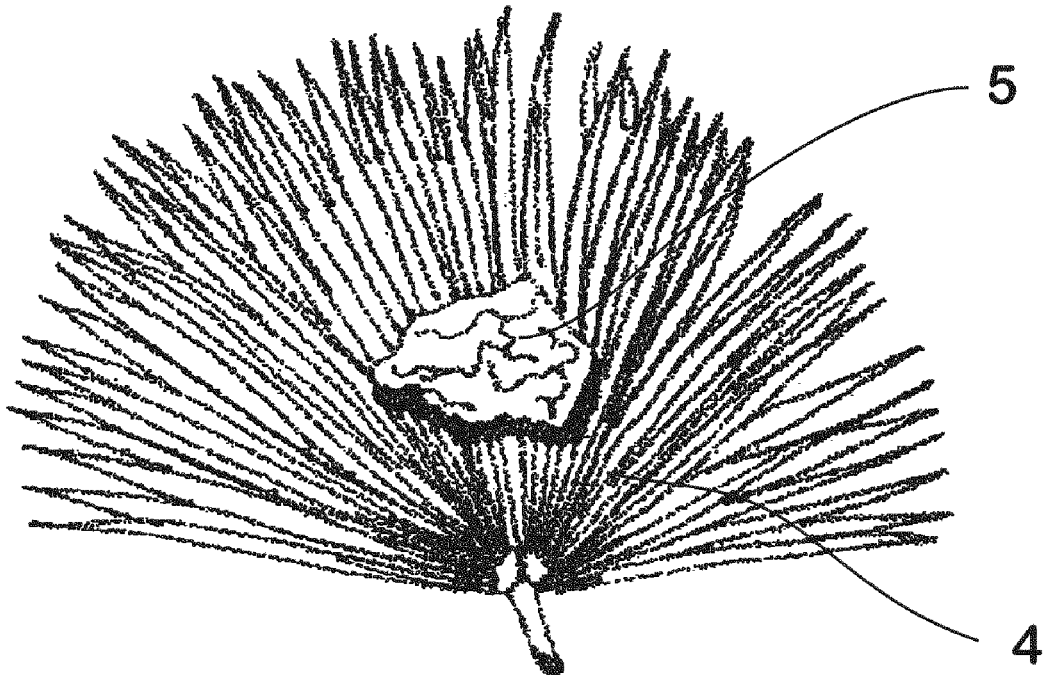
FIG. 6 shows a palm leaf that was cut and has a heavy object on it (e.g., a stone) to avoid shrinking of the leaves.

FIGS. 1 to 6 correspond to the plant called *Brahea dulcis*, which has simple leaves like a fan, green in the fascicle and pale in the back, divided into 40 to 60 segments that measure 40 to 50 cm in length; the leaves 1 are concentrated in the top end of the stem and going down there are some fallen leaves 1. The leaves have marginal teeth 2 2.4 cm in length; the palm leaf presents hanging inflorescence in a raceme shape, which are 1 to 3 m in length.

*Brahea dulcis* is the most abundant species of the *Arecaceae* family and can be found in many calcareous soils located from 900 to 1900 m above sea level. Popular names include "hat palm", "sweet palm", "fan palm", "common palm", "apache palm", "pochitla palm", and "soyal" or "soyate".

When the leaves 4 are ripe they have a fan shape and after they are cut they shrink.

To avoid shrinking a stone or other heavy object 5 is put on them.

Figure 7:
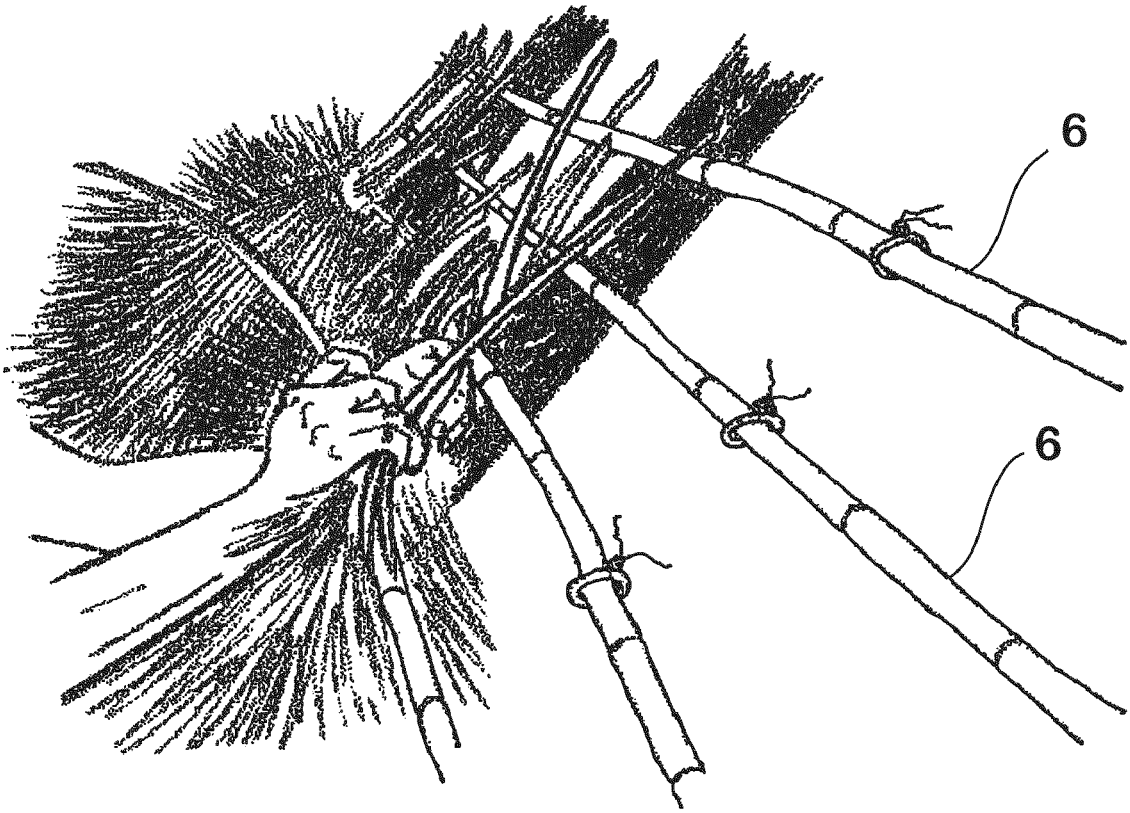
FIG. 7 shows the traditional fastening or fixing of the pressed leaves onto crosspieces.
Figure 8:
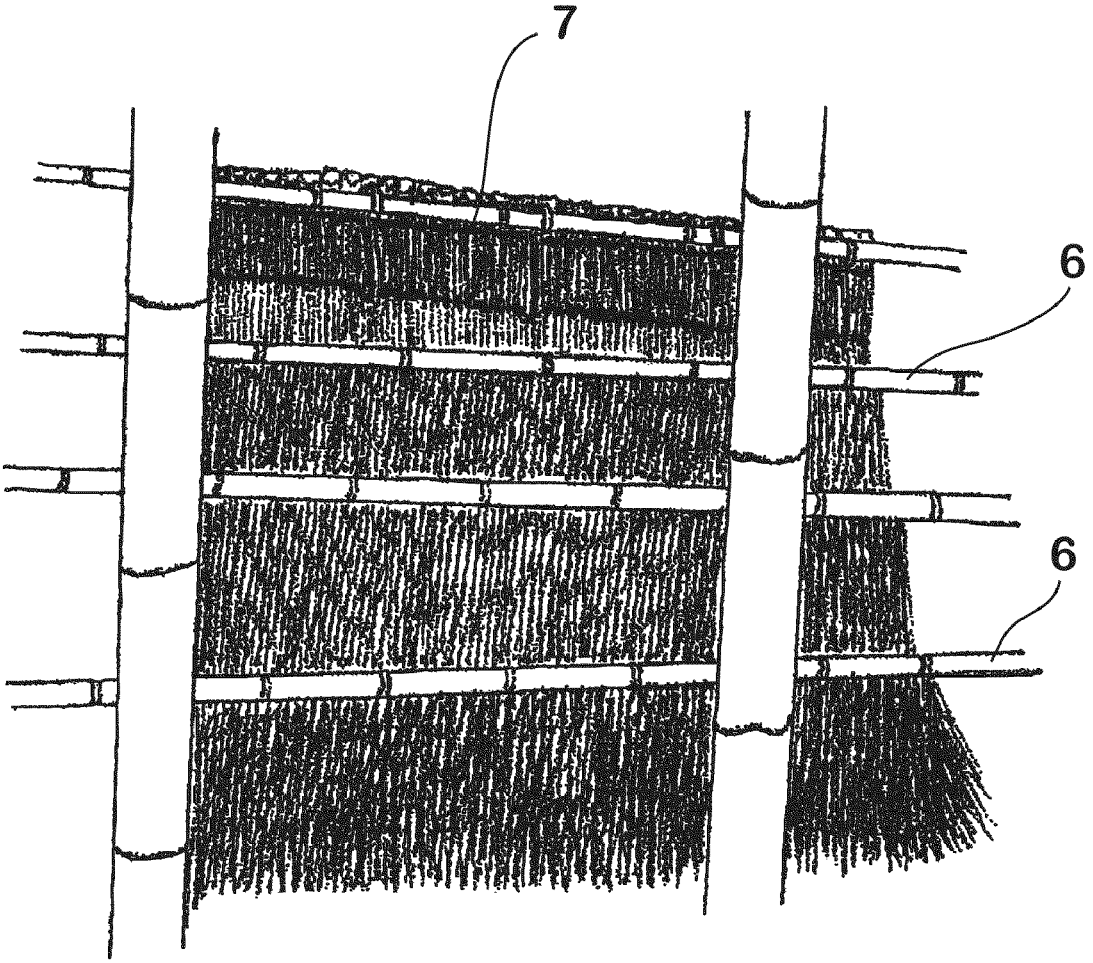
FIG. 8 illustrates the collocation and fastening of a palm tile onto crosspieces.

FIG. 7 shows how roofs are traditionally constructed using pressed palm leaves, where they are individually tied, knitted over the crossbars 6 overlapping its collocation 7. As demonstrated in FIG. 8, by contrast, using self-supporting palm tiles 7 according to the present disclosure, being previously knitted, are hooked onto the crossbars 6 staying firmly fastened.

Figure 9:
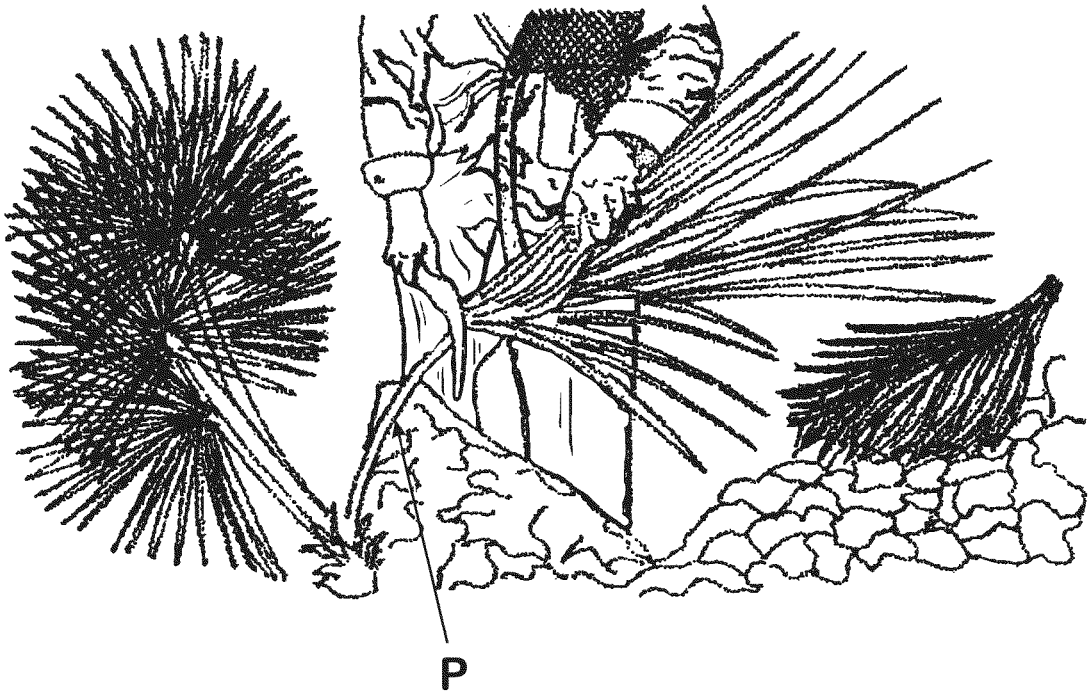
FIG. 9 shows how leaves are collected.
Figure 10:
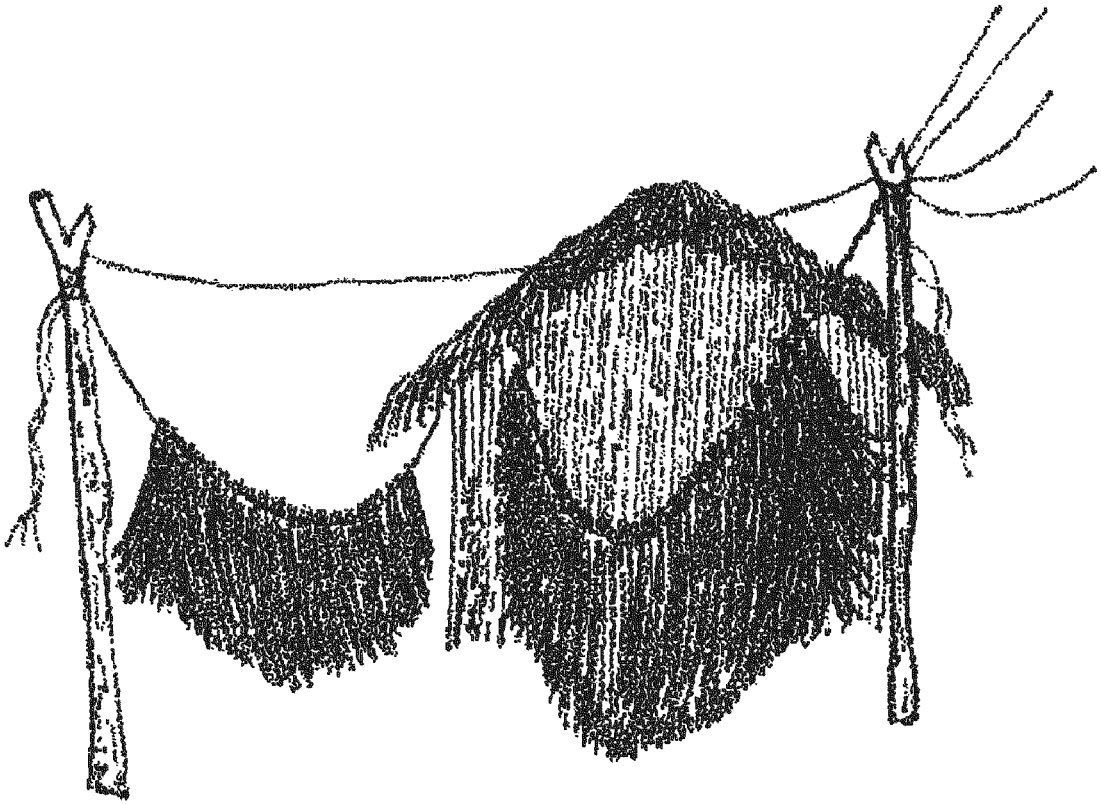
FIG. 10 illustrates the drying of the leaves outdoors with the help of sun rays.
Figure 11:
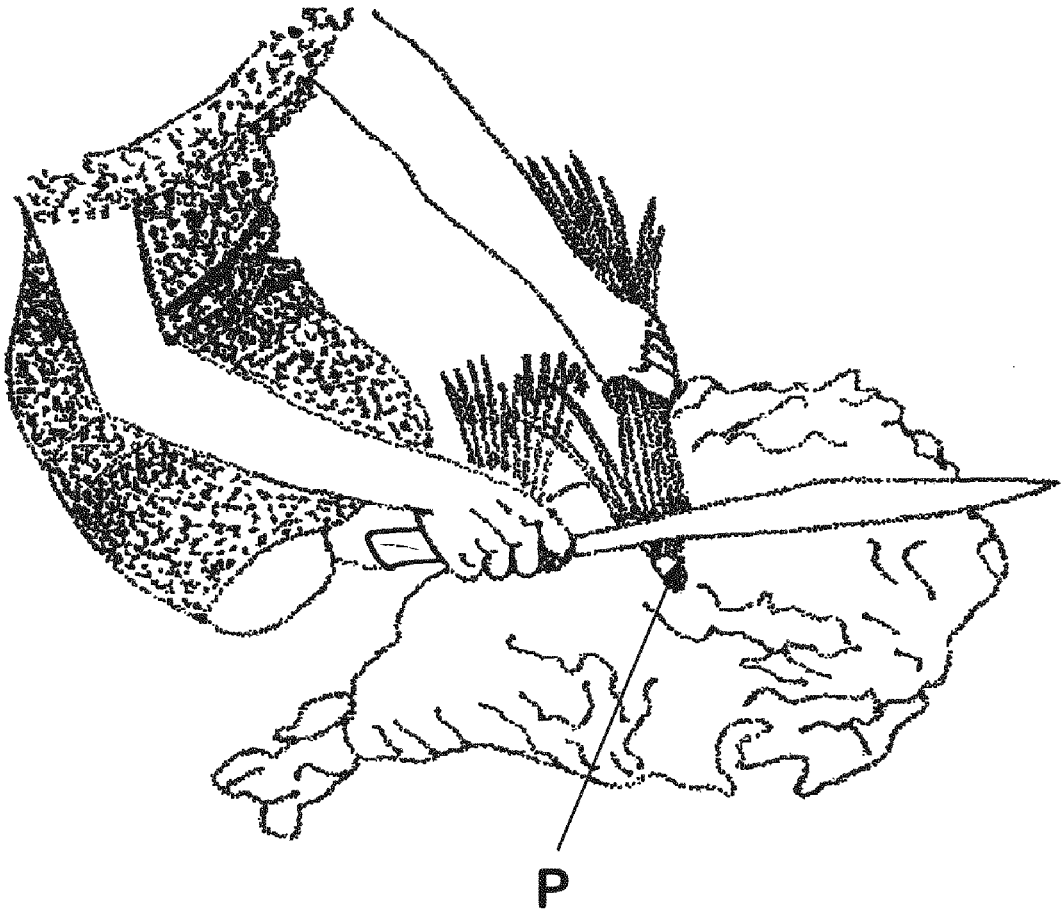
FIG. 11 shows the cutting of the petiole.
Figure 12:
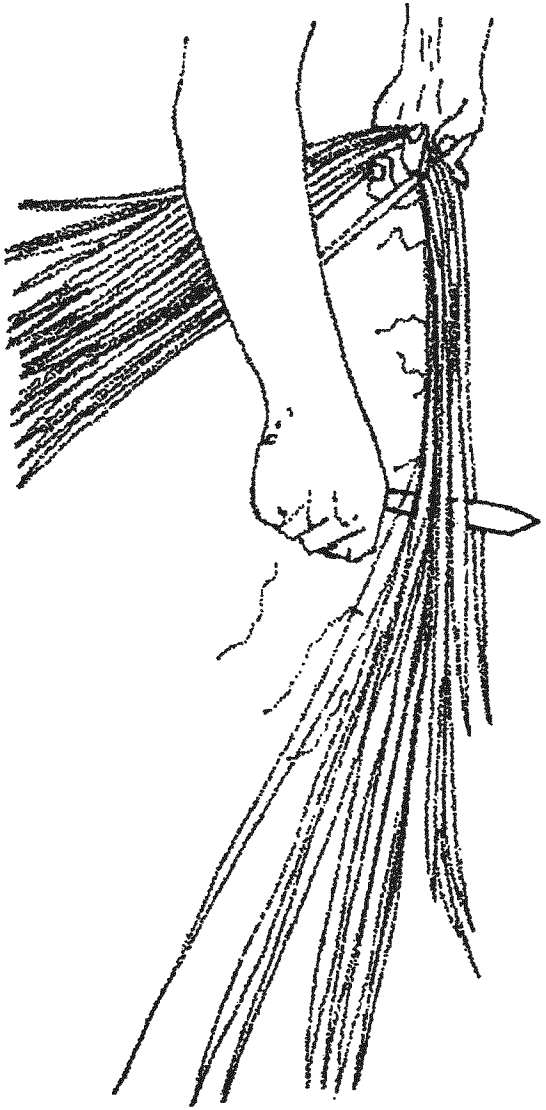
FIG. 12 shows the lengthwise cut of the palm leaf.
Figure 13:
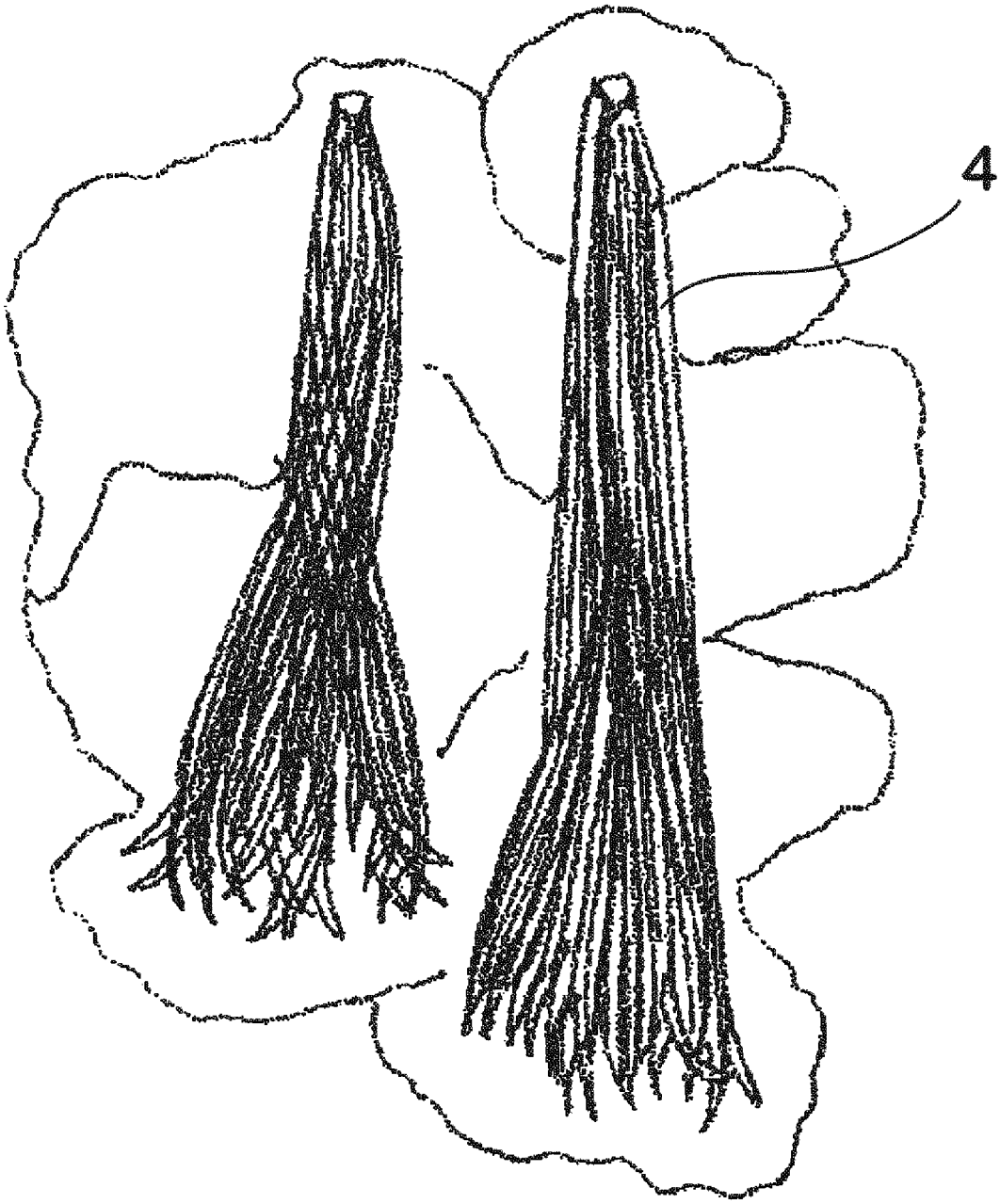
FIG. 13 shows the hanging of the leaves to select sizes.

The procedure to manufacture palm tiles is as follows:

a) Collect the palm leaves manually directly from the tree holding the leaf with one hand and cutting and separating the petiole P with the other (see FIG. 9).

b) Dry the leaves by exposing them directly to the sun rays (see FIG. 10) or by a mechanical dehydrating process using a dehydrator (not shown).

c) Cut the excess of petiole manually or mechanically down to the base (see FIG. 11).

d) Cut or tear the leave lengthwise into two parts (see FIG. 12) using a punching object or a mechanical instrument.

e) Select the leaves by size (see FIG. 13) so they have a uniformed presentation.

f) Place and arrange the leaves two by two (see FIG. 14) in a mold 8 which can be of any size but designed to avoid deformations of the palm tile when it is sewn.

g) Sew, glue, staple, fasten or tie up the leaves using a strap 16 where the fan begins taking advantage of the natural union of the lamina and the petiole.

h) At this stage of the process (or later) the hooks are fixed 9 (when used) onto the finished tile 10 by setting the threads 11 for sewing perpendicularly.

Figure 14:
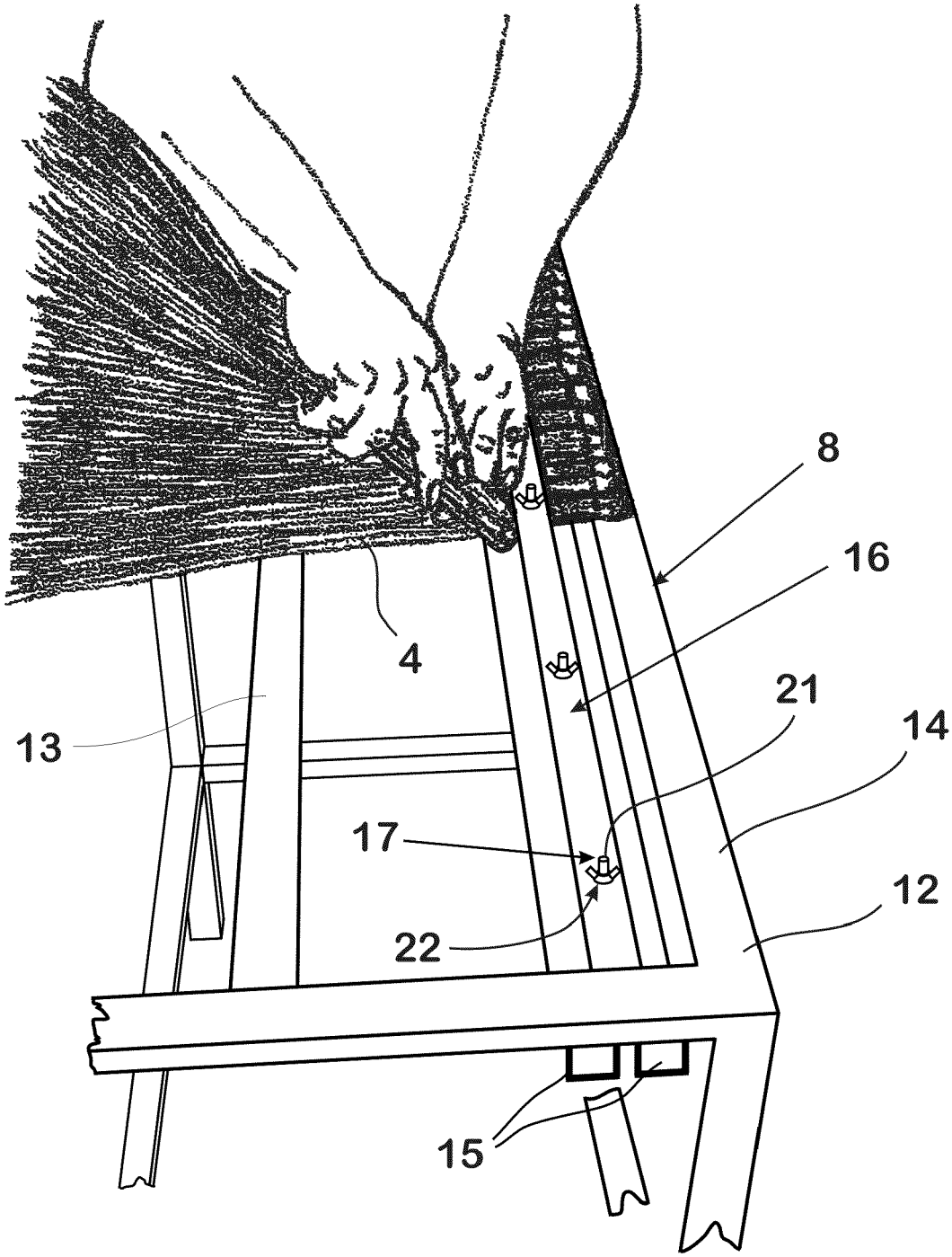
FIG. 14 illustrates the collocation and arrangement of the selected leaves pair by pair in a mold.

FIG. 14 shows a mold 8, which in this particular embodiment is a rectangular table 12 with a crossbar 13 intermediate and an extreme crossbar formed by a crosspiece 14, two lower 15 crossbars and a strap 16 with orifices 22 and screws 21 extending therethrough as shown to screw and tighten it with butterfly nuts 17 to press the leaves between strap 16 and lower cross-bars 15.

Figure 15:
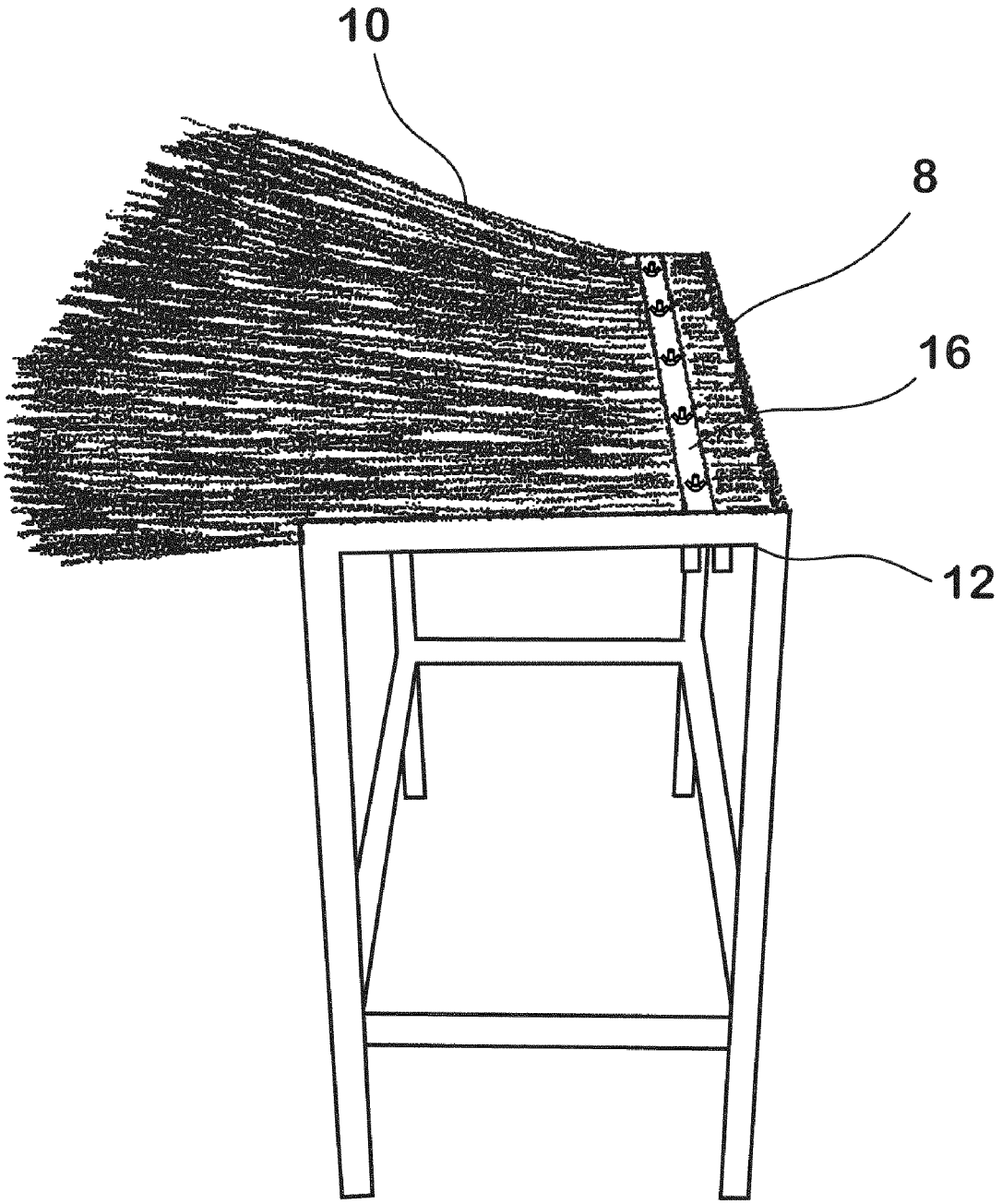
FIG. 15 shows the mold with the leaves set and fixed and screwed with a crossbar to prevent movement.

FIG. 15 shows the mold 8 as a rectangular table 12 with the leaves set and fixed and screwed with a crossbar to prevent movement.

Figure 16:
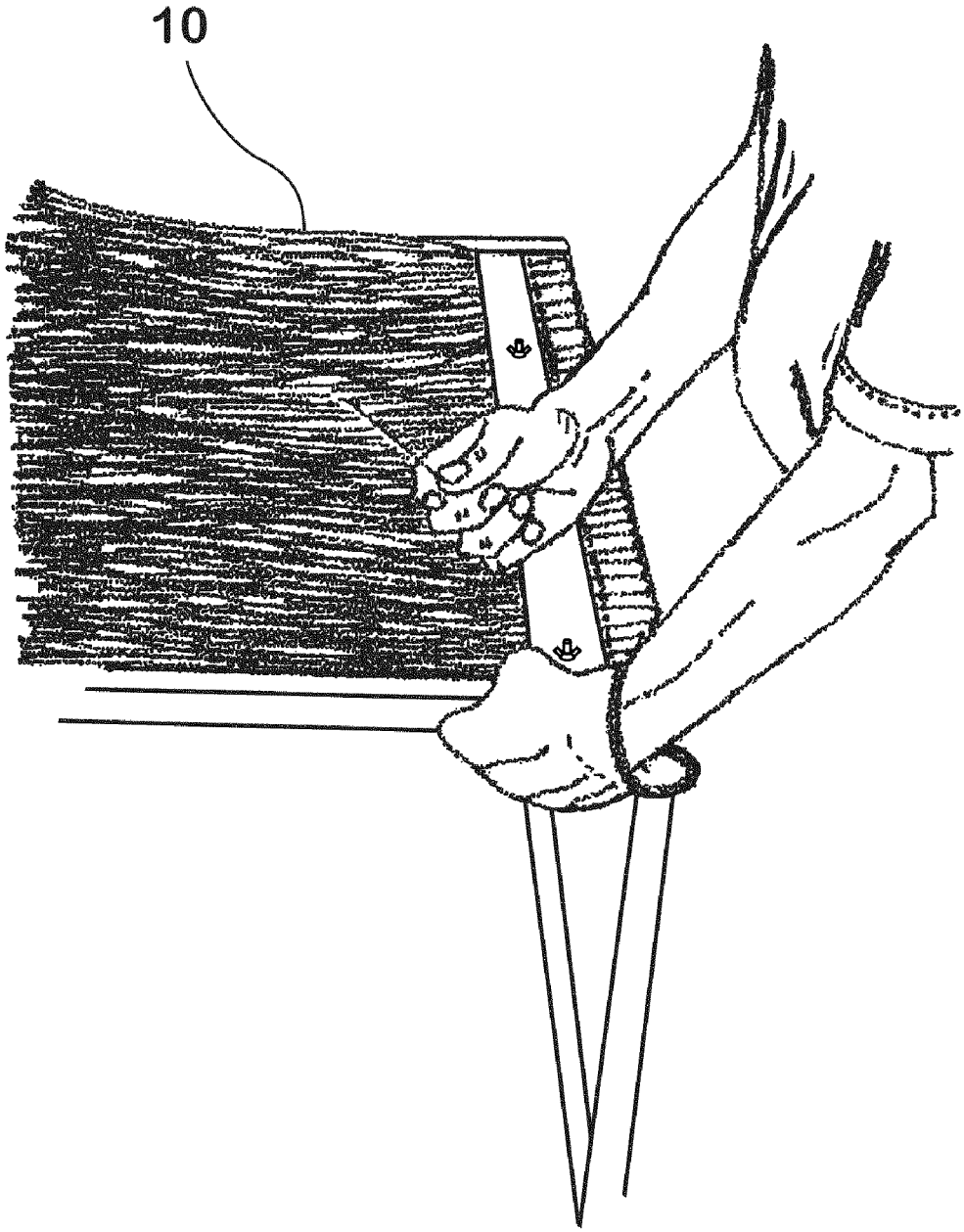
FIG. 16 shows the sewing of the tile, which is in the mold.

FIG. 16 shows the sewing of the tile, which is in the mold.

Figure 17:
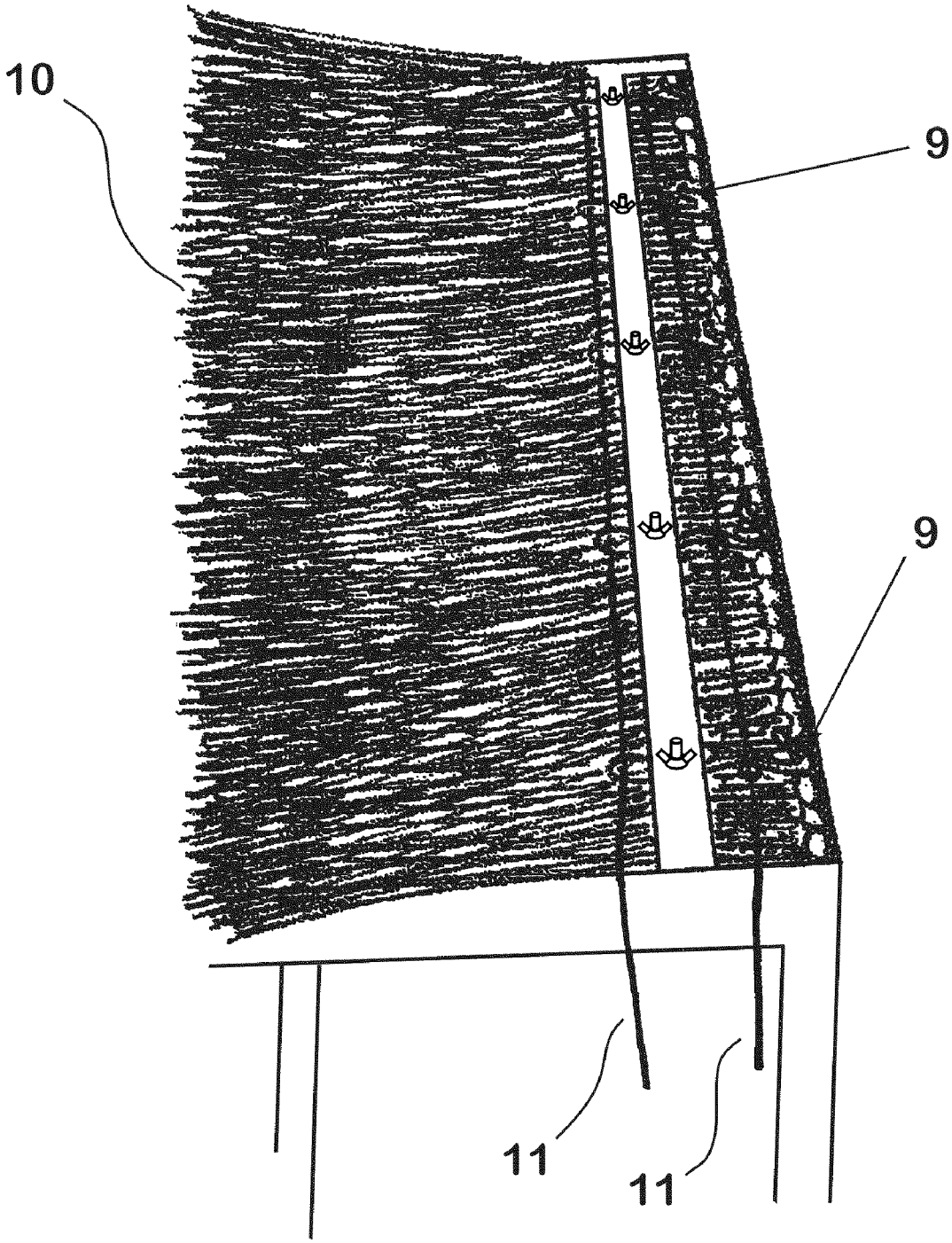
FIG. 17 shows the hooks or clips, whichever are chosen.

FIG. 17 shows the hooks or clips 9, fixed onto the finished tile 10 by threads 11.

Figure 18:
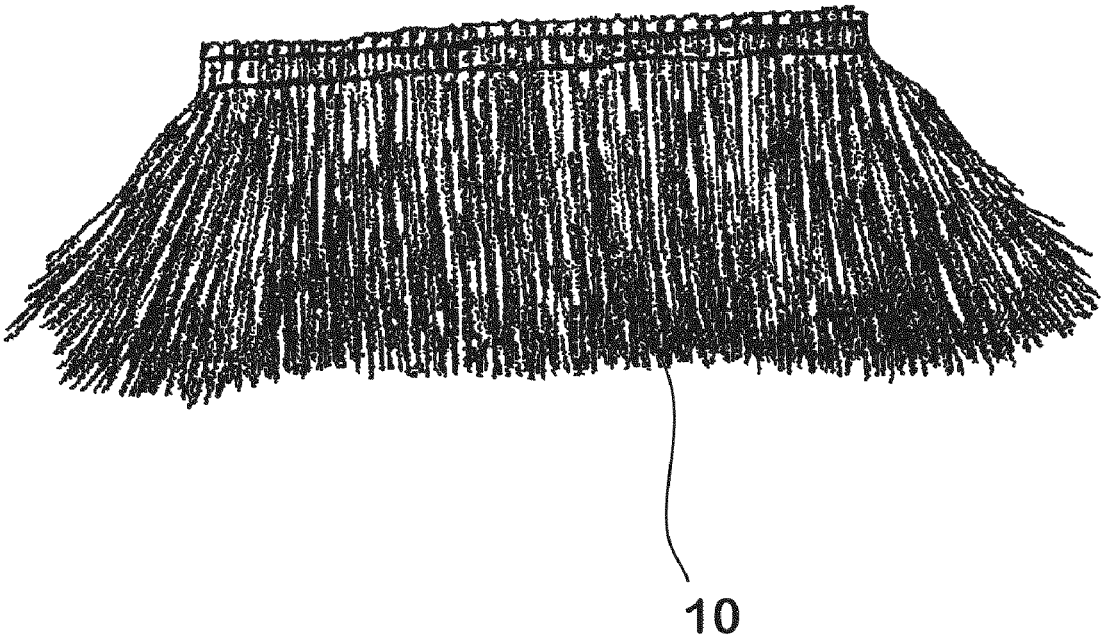
FIG. 18 shows a finished tile.

FIG. 18 shows a finished self-supporting palm tile 10 removed from mold 8 after forming.

Figure 19:
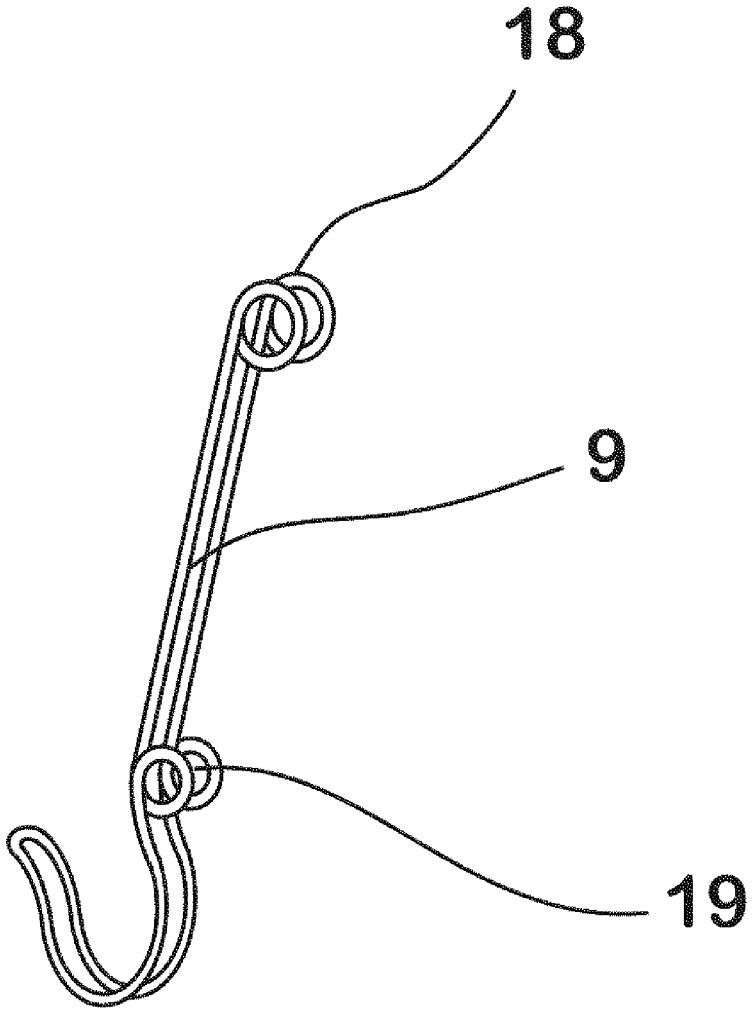
FIG. 19 shows a hook shaped attachment to fasten to the crossbars.

Finally, FIG. 19 shows a hook 9, that has two loops in its body 18 and 19 that are used to hold to the threads for sewing the tile and the hook is held to a crosspiece or "strap" to the structure of hut or palapa fixing the tile. These hooks 9 can be of diverse materials, the most common ones are plastic and wire, their shape and size depend on the crosspiece but the purpose is the same, to hang and to set the tile to form the palm roof.

The palm tiles can be set on the structures that hold them by fixing, fastening with special accessories or stapling them directly onto the crossbars (also called leashes) transplanting their position. Stages b, c, d, and f can be reordered interchangeably.

The leaves and/or the tiles, whether in process or finished, can have a chemical or natural treatment to preserve the color, avoid infestation by plagues or/and delaying or inhibiting fire and/or different finishing measures or special accessories that facilitate the fixing or placement in the structures of huts or palapas that hold them.

The disclosure of every patent, patent application, and publication cited herein is hereby incorporated herein by reference in its entirety.

While this invention has been disclosed with reference to specific embodiments, it is apparent that other embodiments and variations of this invention can be devised by others skilled in the art without departing from the true spirit and scope of the invention. The appended claims include all such embodiments and equivalent variations.

I claim:

1. A palm tile comprising:

palm leaves cut lengthwise or in narrow strips, each of said palm leaves having a lamina and a petiole; and a fastener for holding the palm leaves in a uniform arrangement;

wherein the fastener engages each of the palm leaves at a union between the lamina and the petiole;

wherein the fastener comprises one or more threads placed perpendicular to a length of the palm leaves; and wherein the palm tile further includes at least two hooks, the hooks containing a number of loops, the hooks being fastened to the palm leaves via the one or more threads.

2. The palm tile of claim 1, wherein the palm leaves have a treatment to preserve color, avoid infestation or inhibit fire.

3. The palm tile of claim 1, wherein each of the one or more threads engage at least one of the loops of at least one of the hooks.

4. The palm tile of claim 1, wherein the palm leaves are from *Brahea dulcis*.

5. The palm tile of claim 1, further comprising a plurality clips, hooks, screws or staples fixed to the palm leaves.

6. A palm tile comprising:

palm leaves cut lengthwise or in narrow strips placed in a uniform arrangement;

a plurality of threads oriented perpendicular to the length of the palm leaves; and a plurality of hooks oriented parallel to the length of the palm leaves;

wherein the threads engage the palm leaves at a union between a lamina and a petiole of each of the palm leaves to secure the palm leaves together; and wherein the threads also engage the plurality of hooks to secure the plurality of hooks to the palm tile.

7. The palm tile of claim 6, wherein each hook of the plurality of hooks comprises a pair of loops disposed in a body of the hook, and wherein each of the plurality of threads engage at least one of the loops of each of the plurality of hooks.

8. The palm tile of claim 6, wherein each of the plurality of hooks is disposed adjacent to the union between a lamina and a petiole of each of the palm leaves.

9. The palm tile of claim 6, wherein the palm leaves have a treatment to preserve color, avoid infestation or inhibit fire.

10. The palm tile of claim 6, wherein the palm leaves are from *Brahea dulcis*.

11. The palm tile of claim 6, wherein the plurality of hooks are disposed on only one side of the palm tile.

12. A palm tile comprising:

a plurality of palm leaves placed in a uniform longitudinal arrangement;

a plurality of threads oriented perpendicular to a length of each of the palm leaves; and a plurality of hooks each having a body oriented parallel to the length of the palm leaves, wherein the threads engage the palm leaves and the plurality of hooks to secure the palm leaves together and to secure the plurality of hooks to the palm tile; and wherein the palm tile has a top end and a bottom end, and each of the plurality of hooks is disposed adjacent to the top end of the palm tile.

13. The palm tile of claim 12, wherein each of the plurality of hooks comprises a pair of loops in a body of the hook, wherein each of the plurality of threads engage at least one of the loops.

14. The palm tile of claim 12, wherein each palm leaf of the plurality of palm leaves has a lamina and a petiole, and the plurality of threads engage each of the palm leaves at a union between the lamina and the petiole.

15. The palm tile of claim 14, wherein each of the plurality of hooks is disposed adjacent to the union between the lamina and the petiole of each of the palm leaves.

16. The palm tile of claim 12, wherein the palm leaves have a treatment to preserve color, avoid infestation or inhibit fire.

17. The palm tile of claim 12, wherein the palm leaves are from *Brahea dulcis.*

18. The palm tile of claim 12, wherein the plurality of hooks are disposed on only one side of the palm tile.

* * * * *